United States Patent [19]

Delpato

[11] Patent Number: 4,908,302

[45] Date of Patent: Mar. 13, 1990

[54] SILVER HALIDE COLOR PHOTOGRAPHIC LIGHT-SENSITIVE MATERIAL

[75] Inventor: Ivano Delpato, Savona, Italy

[73] Assignee: Minnesota Mining and Manufacturing Company, St. Paul, Minn.

[21] Appl. No.: 263,398

[22] Filed: Oct. 27, 1988

[30] Foreign Application Priority Data

Nov. 5, 1987 [IT] Italy ..... 22531

[51] Int. Cl.[4] ..... G03C 1/08

[52] U.S. Cl. ..... 430/544; 430/551; 430/957

[58] Field of Search ..... 430/544, 957, 551

[56] References Cited

U.S. PATENT DOCUMENTS

| | | | |
|---|---|---|---|
| 4,387,159 | 6/1983 | Engelmann et al. | 430/544 |
| 4,500,633 | 2/1985 | Menjo et al. | 430/544 |
| 4,528,263 | 7/1985 | Sugita et al. | 430/544 |
| 4,760,016 | 7/1988 | Hirabayashi et al. | 430/544 |
| 4,801,520 | 1/1989 | Inoue et al. | 430/544 |
| 4,818,664 | 4/1989 | Ueda et al. | 430/957 |

*Primary Examiner*—Hoa V. Le

*Attorney, Agent, or Firm*—Donald M. Sell; Walter N. Kirn; Mark A. Litman

[57] ABSTRACT

Light-sensitive silver halide color photographic material comprising a support base having coated thereon at least one silver halide emulsion layer containing a diketomethylene yellow dye forming coupler having in the active coupling position thereof a group providing a compound with development inhibiting properties when the group is released from the active coupling position upon color development reaction, wherein said group corresponds to a 1-(fluoroalkylsubstituted-phenyl)- tetrazolyl-5-thio group.

14 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a photographic coupler and, more particularly, a DIR (Development Inhibitor Releasing) coupler capable of releasing a development inhibiting compound upon reaction with the oxidation product of a developing agent.

BACKGROUND OF THE ART

It is well known that color photographic light-sensitive materials, using the subtractive process for color reproduction, comprise silver halide emulsion layers selectively sensitive to blue, green and red light and associated with yellow, magenta and cyan dye forming couplers which (upon reaction with an oxidized primary amine type color developing agent) form the complementary colors. For example, an acylacetanilide type coupler is used to form a yellow color image; a pyrazolone, pyrazolotriazole, cyanacetophenone or indazolone type coupler is used to form a magenta color image; and a phenol type, such as a phenol or naphthol, coupler is used to form a cyan color image.

Usually, the color photographic light-sensitive materials comprise non-diffusible couplers incorporated independently in each of the light-sensitive layers of the material (incorporated coupler materials). Therefore, a color photographic light-sensitive material usually comprises a blue-sensitive silver halide emulsion layer (or layers) which contains a yellow coupler and is sensitive mainly to the blue light (substantially to wavelenghts less than about 500 nm), a green-sensitive silver halide emulsion layer (or layers) which contains a magenta coupler and is sensitive mainly to green light (substantially to wavelengths of about 500 to 600 nm) and a red-sensitive silver halide emulsion layer (or layers) which contains a cyan coupler and is sensitive mainly to red light (substantially to wavelengths longer than about 590 nm).

It is also known to incorporate into a ligh-sensitive color photographic material a compound capable of releasing a development inhibitor during development upon reaction with the oxidation product of a color developing agent. Typical examples of said compounds are the DIR (Development Inhibitor Releasing) couplers having a group having a development inhibiting property when released from the coupler itself. These groups are introduced in the coupling position of the coupler. Examples of DIR couplers are described by C. R. Barr, J. R. Thirtle and P. W. Wittum, Photographic Science and Eng., vol. 13. pp 74–80 (1969) and ibid. pp 214–217 (1969) or in U.S. Pat. Nos. 3,227,554, 3,615,506, 3,617,291, 3,701,783, 3,933,500 and 4,149,886.

The purpose of DIR couplers is to reduce grainines and improve sharpness of the image due to intralayer (or intraimage) effects and improve color reproduction due to interlayer (or interimage) effects. Usually, however, the DIR coupler causes, in the light-sensitive emulsion layer in which it is used, a strong development-restraining effect upon development which reduces maximum color density (Dmax) and a lowering of the sensitivity. Therefore, in order to more effectively use the DIR couplers, it is desirable to develop novel DIR couplers which reduce maximum color density (Dmax) and sensitivity to a lesser extent and provide an improved image quality.

Several substituents on the phenyl ring of the 1-phenyl-tetrazolyl-5-thio development inhibiting group of DIR couplers have been described, for example in DE patent applications Nos. 2,454,301 and 2,454,329 and in BE Pat. No. 789,595. Among these, a $CF_3$ substituent has been described in BE patent 789,595 in phenolic or naphtholic couplers for use as cyan dye forming DIR couplers.

SUMMARY OF THE INVENTION

The present invention relates to a silver halide color photographic light-sensitive material which comprises a support having coated thereon at least one silver halide emulsion layer containing a diketomethylene yellow dye forming coupler having, in the coupling active position thereof, a group which provides a compound having a development inhibiting property when the group is released from the coupler active position upon color development reaction, wherein said group corresponds to a 1-(fluoroalkylsubstituted-phenyl)-tetrazolyl-5-thio group.

Said silver halide color light-sensitive material containing the novel yellow dye forming DIR coupler, upon exposure and development, provides color images of improved image quality without causing any reduction of color density and sensitivity.

DETAILED DESCRIPTION OF THE INVENTION

The photographic DIR couplers according to the present invention are characterized by having a 1-(fluoroalkylsubstituted-phenyl)-tetrazolyl-5-thio group attached to the active methylene group (coupling active position) of the yellow dye forming coupler through the sulphur atom of said group.

The DIR couplers according to the present invention can be represented by the formula (I):

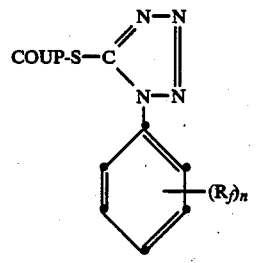

(I)

wherein COUP is a diketomethylene yellow dye forming coupler residue, S is a thio group attached to the coupling active position of COUP, $R_f$ is a fluoroalkyl group and n is an integer of 1 to 5.

The fluoroalkyl group attached to the 1-phenyl ring of a 1-phenyl-tetrazolyl-5-thio releasable group of the diketomethylene yellow dye forming coupler gives unique results in terms of image quality while the same fluoroalkyl group did not provide such results in the same 1-phenyl-tetrazolyl-5-thio substituent attached to phenol and naphthol cyan dye forming couplers. The fluoroalkyl group of formula (I) above represents an alkyl group wherein the hydrogen atoms are partially or completely substituted with fluorine atoms. Preferably, said fluoroalkyl group represents an alkyl group having an average of at least one fluorine atom per carbon atom, more preferably an average of at least 1.5 fluorine atoms per carbon atom. Still more preferably, said fluororalkyl group is a perfluoroalkyl group (i.e. an alkyl group wherein all hydrogen atoms have been substituted with fluorine atoms). The length of the fluoroalkyl groups in terms of number of carbon atoms, as well as the number of said fluoroalkyl groups are preferably chosen not to make the development inhibitor moiety, released from the DIR coupler, too heavy which would negatively affect the desired interlayer effects. Accordingly, with reference to the length, said fluoroalkyl group is preferably a fluorinated low alkyl group having 1 to 4 carbon atoms, and more preferably said fluoroalkyl is a $CF_3$ group. With reference to the number of fluoroalkyl groups attached to the phenyl ring of the 1-phenyltetrazolyl-5-thio group, preferably said number is 1 to 3 and more preferably is 1.

With reference to the position of said fluoroalkyl groups attached to the phenyl ring, any available position of the phenyl ring can be used. In case of one fluoroalkyl group the ortho, meta or para position can be used. In case of two fluoroalkyl groups the combined substitution of the two meta positions is preferred although the ortho-para, ortho-meta and para-meta combinations are believed to work similarly. In case of three fluoroalkyl groups the diortho-para combination is preferred even though other combinations (such as the combination of one of ortho, meta and para positions) are believed to work similarly.

With the reference to the diketomethylene yellow dye forming coupler residue represented by COUP above, any residue of diketomethylene yellow dye forming coupler known in the art may be used. By the term "residue" is meant the substantive portion of the coupler, exclusive of a splitting-off or leaving group attached at the coupling site. Examples of diketomethylene yellow dye forming couplers include pivaloylacetanilide type couplers, benzoylacetanilide type couplers, malondiester type couplers, malondiamide type couplers, dibenzoylmethane type couplers, malonester monoamide type couplers, benzothiazolylacetate type couplers, benzoxazolylacetamide type couplers, benzoxazolylacetate type couplers, benzimidazolylacetamide type couplers or benzimiazolylacetate type couplers, hetero ring substituted acetamide or hetero ring substituted acetate type couplers, as described in U.S. Pat. No. 3,841,880, acylacetamide type couplers, as described in U.S. Pat. No. 3,770,446, in GB patent No. 1,459,171, in DE patent application No. 2,503,099, in JA patent application No. 139738/75 and in Research Disclosure No. 15737, a heterocyclic type coupler, as described in U.S. Pat. No. 4,046,574, or the like.

Preferred examples of diketomethylene yellow dye forming DIR couplers according to the present invention are represented by the general formula (II):

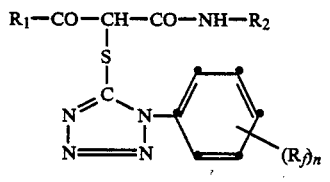

(II)

wherein:

$R_1$ represents an alkyl group, an aryl group or a $—NR_3R_4$ group, wherein $R_3$ represents a hydrogen atom or an alkyl group and $R_4$ represents an alkyl group or an aryl group, $R_2$ represents an alkyl group or an aryl group, $R_f$ represents a fluoroalkyl group as defined in formula (I) and n represents an integer of 1 to 5.

In the formula (II) above, the alkyl group represented by $R_1$, $R_2$ and $R_4$ has preferably from 1 to 18 carbon atoms and may be substituted or unsubstituted. Preferred examples of substituents of the alkyl group include an alkoxy group, an aryloxy group, a cyano group, an amino group, an acylamino group, a halogen atom, an hydroxy group, a carboxy group, a sulfo group, a heterocyclic group, etc. Practical examples of useful alkyl groups are an isopropyl group, an isobutyl group, a tert.-butyl group, an isoamyl group, a tert.-amyl group, a 1,1-dimethylbutyl group, a 1,1-dimethylhexyl group, a 1,1-diethylhexyl group, a 1,1-dimethyl-1-methoxyphenoxymethyl group, a 1,1-dimethyl-1-ethylthiomethyl group, a dodecyl group, a hexadecyl group, an octadecyl group, a cyclohexyl group, a 2-methoxyisopropyl group, a 2-phenoxyisopropyl group, an α-aminoisopropyl group, an α-succinimidoisopropyl group, etc.

The aryl group represented by $R_1$, $R_2$ and $R_4$ has preferably from 6 to 35 total carbon atoms and includes in particular a substituted phenyl group and an unsubstituted phenyl group. Preferred examples of substituents of the aryl group include a halogen atom, a nitro group, a cyano group, a thiocyano group, a hydroxy group, an alkoxy group (preferably having 1 to 15 carbon atoms, such as methoxy, isopropoxy, octyloxy, etc.), an aryloxy group (such as phenoxy, nitrophenoxy, etc.), an alkyl group (preferably having 1 to 15 carbon atoms, such as methyl, ethyl, dodecyl, etc.), an alkenyl group (preferably having 1 to 15 carbon atoms, such as allyl), an aryl group (preferably having 6 to 10 carbon atoms, such as phenyl, tolyl, etc.), an amino group (e.g. an unsubstituted amino group or an alkylamino group having 1 to 15 carbon atoms such as diethylamino, octylamino, etc.), a carboxy group, an acyl group (preferably having 2 to 16 carbon atoms such as acetyl, decanoyl, etc.), an alkoxycarbonyl group (eherein the alkyl moiety preferably has 1 to 20 carbon atoms, such as methoxycarbonyl, butoxycarbonyl, octyloxycarbonyl, dodecyloxycarbonyl, 2-methoxyethoxycarbonyl, etc.), an aryloxycarbonyl group (wherein the aryl moiety preferably has 6 to 20 carbon atoms, such as phenoxycarbonyl, tolyloxycarbonyl, tolyoxycarbonyl, etc.), a carbamoyl group (such as ethylcarbamoyl, octylcarbamoyl, etc.), an acylamino group (preferably having 2 to 21 carbon atoms, such as acetamido, octanamido, 2,4-ditert.-pentylphenoxyacetamido, etc.), a sulfo group, an alkylsulfonyl group (preferably having 1 to 15 carbon atoms, such as methylsulfonyl, octylsulfonyl, etc.), an arylsulfonyl (preferably having 6 to 20 carbon atoms, such as phenylsulfonyl, octyloxyphenylsulfonyl, etc.), an alkoxysulfonyl (preferably having 1 to 15 carbon atoms, such as methoxysulfonyl, octyloxysulfonyl, etc.), an aryloxysulfonyl (preferably having 6 to 20 carbon atoms, such as phenoxysulfonyl, etc.), a sulfamoyl group (preferably having 1 to 15 carbon atoms, such as diethylsulfamoyl, octylsulfamoyl, methyloctadecylsulfamoyl, etc.), a sulfonamino group (preferably having 1 to 15 carbon atoms, such as methylsulfonamino, octylsulfonamino, etc.) and the like.

The alkyl group represented by $R_3$ in the formula (II) above is preferably a lower alkyl group having 1 to 4 carbon atoms, such as methyl, ethyl, n-propyl, iso-propyl, n-butyl, iso-butyl or tert.-butyl.

The total number of carbon atoms of $R_1$, $R_2$, $R_3$ and $R_4$ in the formula (II) above is preferably less than 50, more preferably less than 40.

Still prefered examples of yellow dye forming DIR couplers according to the present invention are represented by the general formula (III):

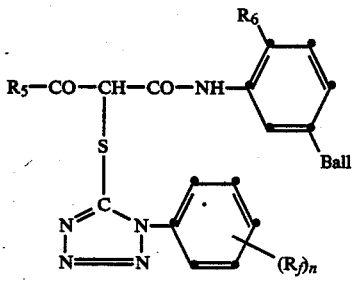

(III)

wherein $R_5$ represents an alkyl group or an aryl group, $R_6$ represents a halogen atom, an alkoxy group or an alkyl group, $R_f$ is a fluoroalkyl group as defined in formula (I), n is an integer of 1 to 3 and Ball is a hydrophobic ballasting group.

In the formula (III) above, the alkyl group represented by $R_5$ has preferably from 3 to 8 carbon atoms and more preferably is a branched chain alkyl group (such as, for example, an isopropyl group, a tert.-butyl group or a tert.-amyl group), and the aryl group represented by $R_5$ is preferably a phenyl group optionally substituted by alkyl or alkoxy groups having 1 to 5 carbon atoms (for example, a 2- or 4-akylphenyl group such as a 2-methylphenyl group, or a 2- or 4-alkoxyphenyl group such as a 2-methoxyphenyl group, a 4-isopropoxyphenyl group or a 2-butoxyphenyl group). $R_6$ represents a halogen atom (such as chlorine) or an alkyl or alkoxy group having 1 to 4 carbon atoms (such as methyl, ethyl, propyl, isoproyl, n-butyl, tert.-butyl, methoxy, ethoxy, propoxy, isopropoxy, n-butoxy and tert.-butoxy groups).

The ballasting group (Ball) of the formula (III) above acts as a "ballast" which can mantain the coupler in a specific layer so as to substantially prevent said coupler from diffusing to the other layers of a multilayer color photographic element. Said group has a sufficient bulkiness to complete that purpose. Usually a group having a hydrophobic group of 8 to 32 carbon atoms is introduced into the coupler molecule as a ballasting group. Such group can be bonded to the coupler molecule directly or through an amino, ether, carbonamido, sulfonamido, ureido, ester, imido, carbamoyl, sulfamoyl, phenylene, etc., bond. Specific examples of ballasting groups are illustrated in U.S. Pat. No. 4,009,083, in European patent Nos. 87,930, 84,100, 87,931, 73,146, and 88,563, in German patent Nos. 3,300,412 and 3,315,012, in Japanese patent Nos. 58/33248, 58/33250, 58/31334, 58/106539. Preferably, such ballasting groups comprise alkyl chains, the total carbon atoms of which are no more than 20.

Still more preferred examples of yellow dye forming DIR couplers are represented by the general formula (IV) or (V):

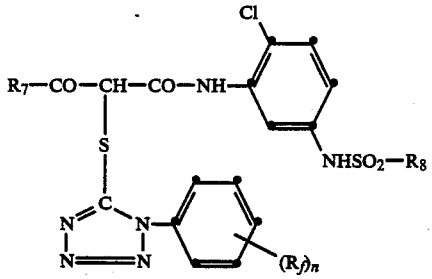

(IV)

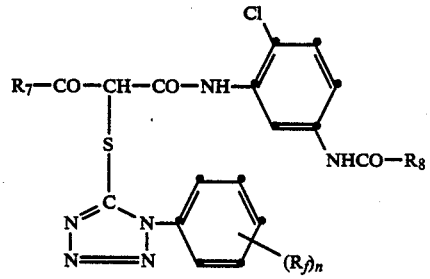

(V)

wherein $R_7$ represents a branched chain alkyl group, preferably a branched chain alkyl group having 3 to 8 carbon atoms (such as, for example, a isopropyl group, an isobutyl group, a tert.-butyl group or a tert.-amyl group , $R_8$ represents an alkyl group, preferably an alkyl group having 8 to 22 carbon atoms (such as, for example, a dodecyl group, a tetradecyl group, a hexadecyl group or an octadecyl group), a phenoxyalkyl group, preferably a phenoxyalkyl group having 10 to 32 carbon atoms (such as, for example, a gamma-(2,4-ditert.-amylphenoxy)-propyl group), an alkoxyphenyl group, preferably an alkoxyphenyl group having 10 to 32 carbon atoms, or an aralkyl group, preferably an aralkyl group having 10 to 32 carbon atoms, $R_f$ represents a fluoroalkyl group as defined for formula (I) and n is an integer of 1 to 5.

In another aspect of the present invention the 1-(fluoroalkylsubstituted-phenyl)-tetrazolyl-5-thio group is attached to the active methylene group (coupling active position) of a diketomethylene yellow dye forming coupler through a connecting group. In particular, said connecting group is a timing group joining the coupler and the 1-(fluoroalkylsubstituted-phenyl)-tetrazolyl-5-thio group, said timing group being displaced from said coupler upon reaction with an oxidized color developing agent and the resulting timing and 1-(phenyl-alkylsubstituted)-tetrazolyl-5-thio group being able to undergo a reaction (such as an intramolecular nucleophilic displacement reaction as described in U.S. Pat. No. 4,248,962 or a reaction of electron transfer along a conjugated system as described in U.S. Pat. No. 4,409,323) to release the 1-(alkylsubstituted-phenyl)-tetrazolyl-5-thio group.

Preferred examples of yellow dye forming DIR couplers according to said aspect of the present invention are represented by the general formula (VI):

(VI)

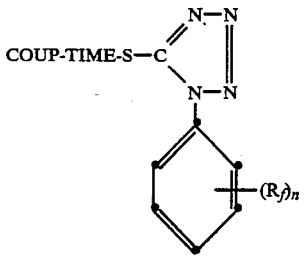

wherein COUP is the yellow dye forming coupler residue as defined before, TIME is a timing group joining the coupler residue to the 1-(alkylsubstituted-phenyl)-tetrazolyl-5-thio group, $R_f$ is a fluoroalkyl group as defined in formula (I) and n is an integer of 1 to 5.

Examples of timing groups represented by TIME in formula (VI) include, for example, the following groups:

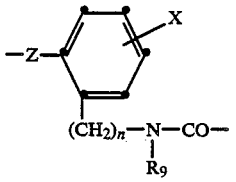

wherein Z is oxygen or sulfur and is attached to the coupler moiety COUP, n is 0 or 1, $R_9$ is hydrogen or an alkyl of 1 to 4 carbon atoms or an aryl of 6 to 10 carbon atoms, X is hydrogen, halogen, cyano, nitro, alkyl of 1 to 20 carbon atoms, alkoxy, alkoxycarbonyl, aminocarbonyl, etc., as described in U.S. Pat. No. 4,248,962,

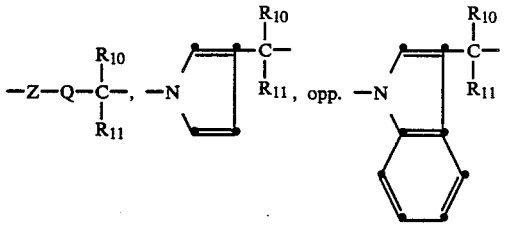

wherein the left hand side is attached to the coupler moiety COUP, Z is oxygen or sulfur or

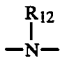

$R_{10}$, $R_{11}$ and $R_{12}$ are individually hydrogen, alkyl or aryl groups, and Q is a 1,2- or 1,4-phenylene or naphthylene group, as described in U.S. Pat. No. 4,409,323.

Specific examples of yellow dye forming DIR couplers of the present invention are given below as illustrative examples.

(Coupler 1)

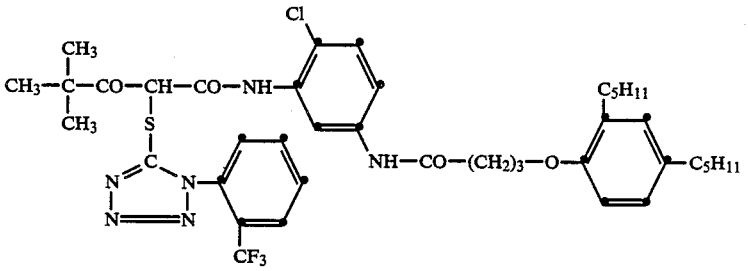

(Coupler 2)

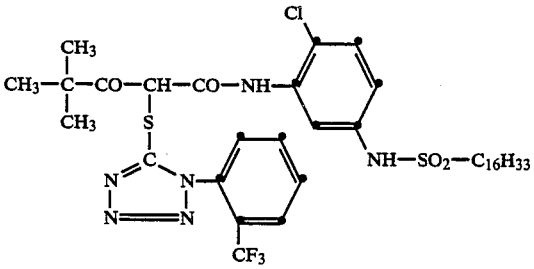

(Coupler 3)

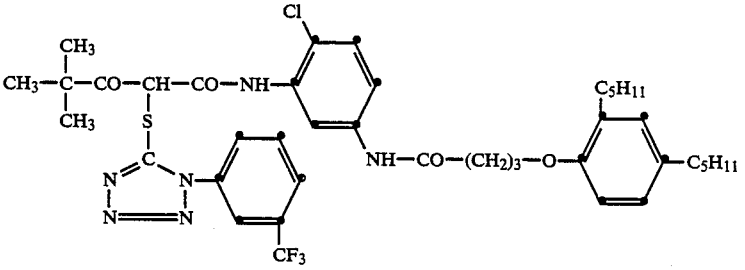

-continued
(Coupler 4)
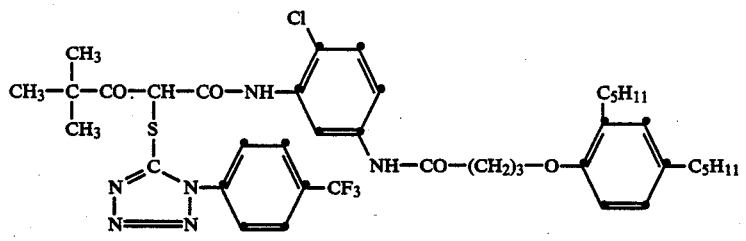
(Coupler 5)
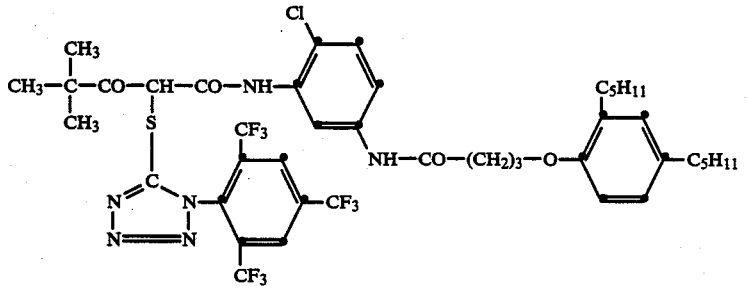
(Coupler 6)
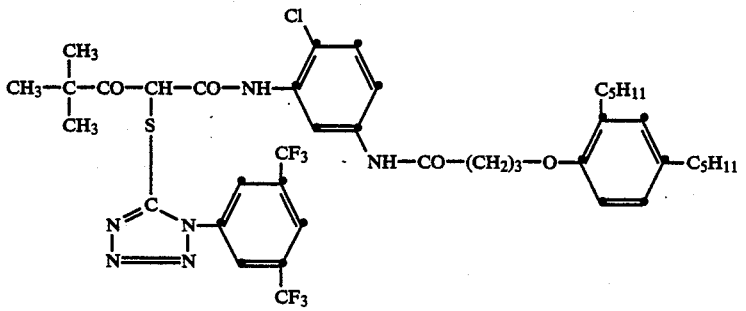
(Coupler 7)
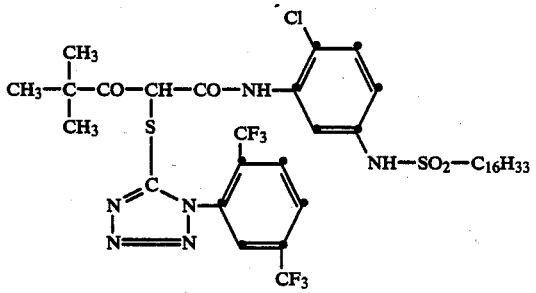
(Coupler 8)
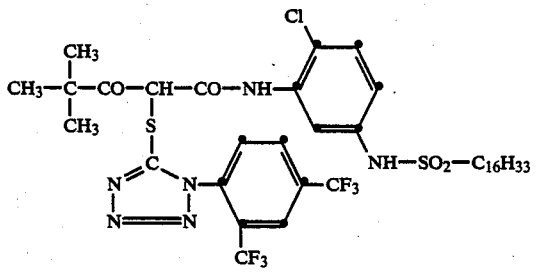

-continued
(Coupler 9)
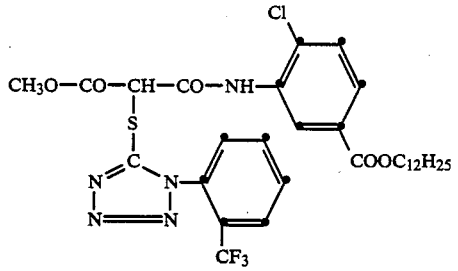
(Coupler 10)
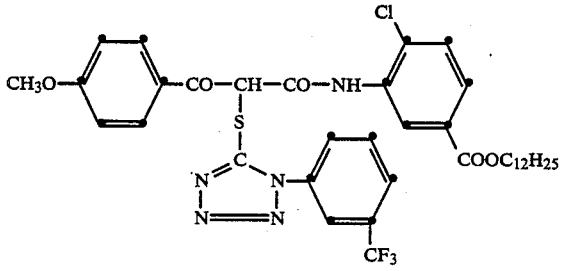
(Coupler 11)
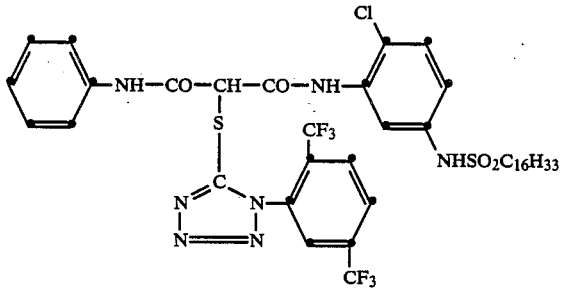
(Coupler 12)
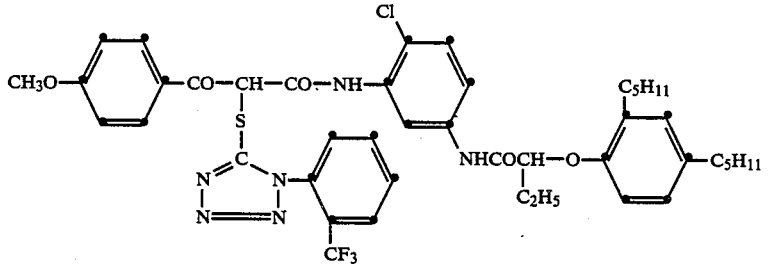
(Coupler 13)
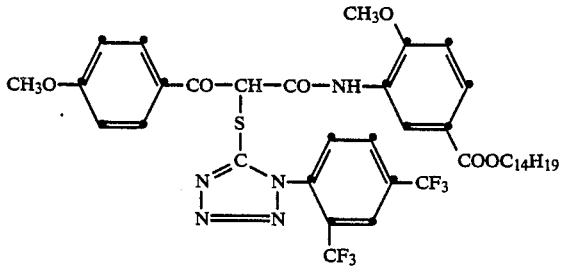
(Coupler 14)
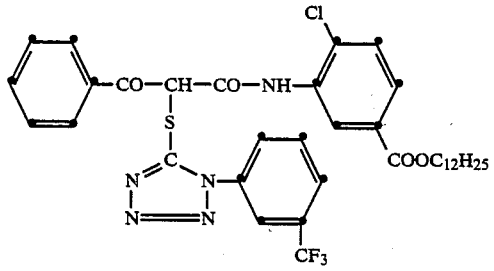

-continued
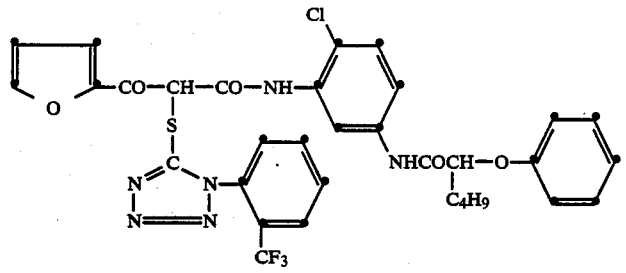
(Coupler 15)
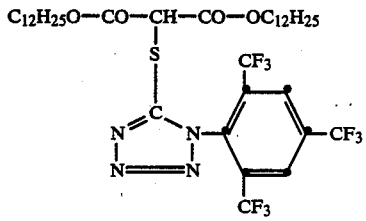
(Coupler 16)
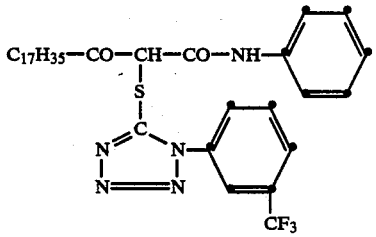
(Coupler 17)
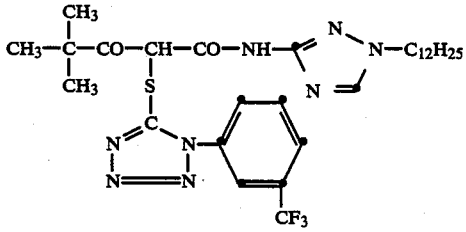
(Coupler 18)
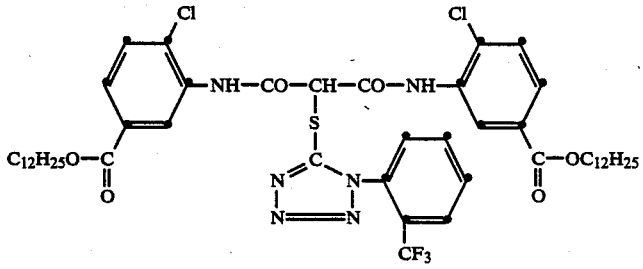
(Coupler 19)
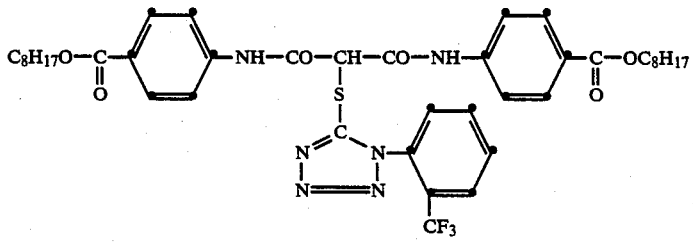
(Coupler 20)

-continued
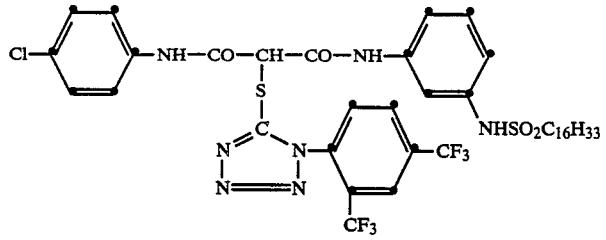
(Coupler 21)
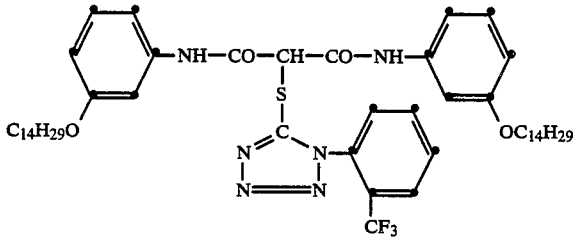
(Coupler 22)
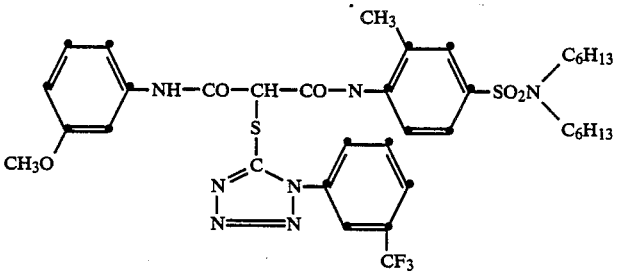
(Coupler 23)
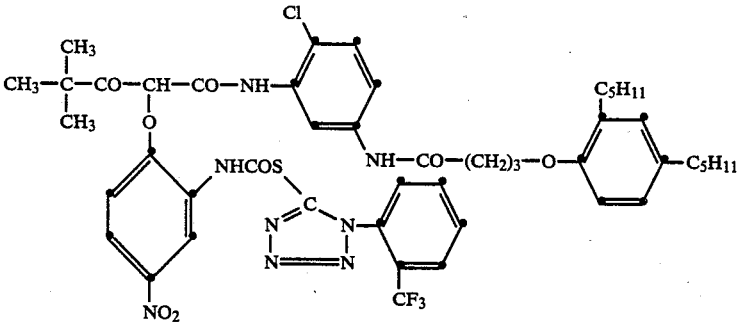
(Coupler 24)
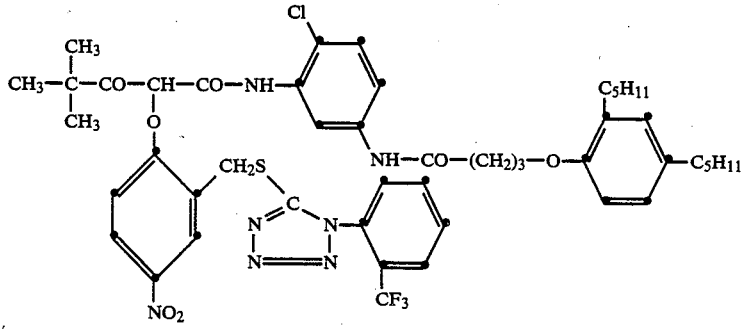
(Coupler 25)

-continued

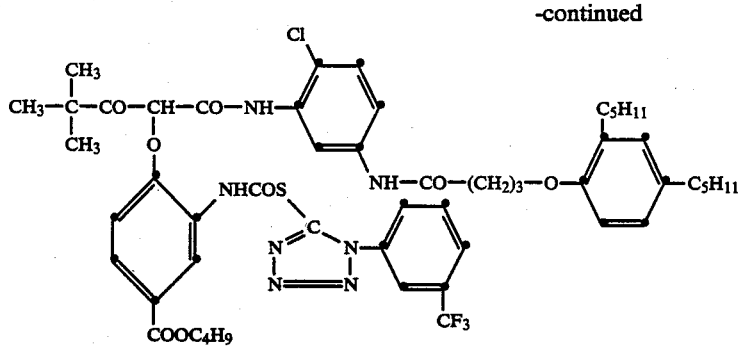

(Coupler 26)

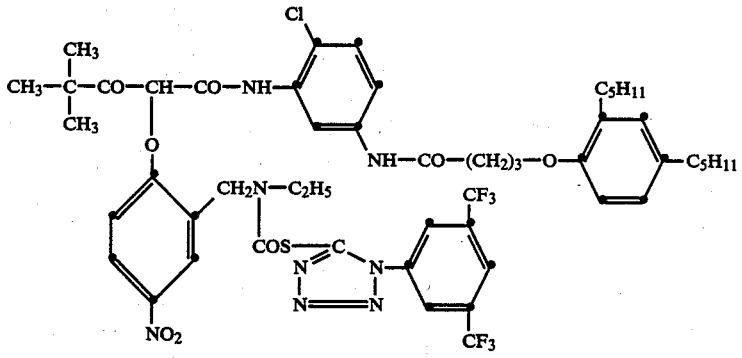

(Coupler 27)

The couplers of the present invention can be synthesized according to conventional ways as those for synthesizing DIR couplers. A typical example of a synthesis of the couplers of the present invention is given below.

SYNTHESIS EXAMPLE

Synthesis of Coupler (1)

The coupler can be synthesized through the following synthesis route:

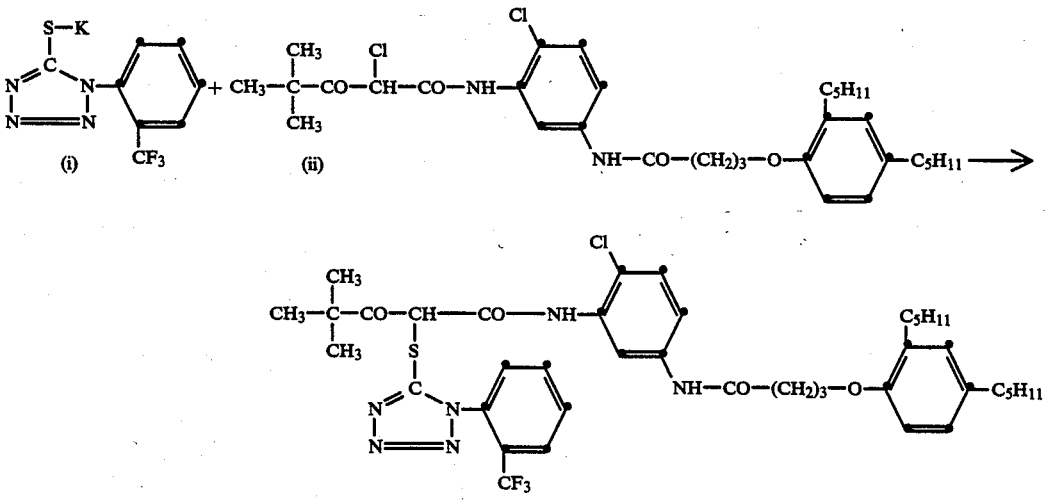

(Coupler 1)

Step 1: Synthesis of Compound (i)

To thiophosgene (18 g, 0.156 mole) in acetone (ml 200) was added under stirring and cooling 2-trifluoromethylaniline (26 g, 0.164 mole). The cooling was removed and the mixture was kept under stirred overnight. The solvent was removed under vacuum and the residue taken-up in ethylacetate (200 ml), filtered, exctracted twice with cold 10% hydrochloric acid and twice with brine. Drying over sodium sulphate was followed by removal of the solvent and distillation of the resulting oil to give, after a forerun consisting of mesityloxide (B.P. 45° C. at 60 mmHg, 2 g), the trifluoromethylphenylisothiocyanate (B.P. 80° C. at 5 mmHg, 15 g). To a 75% ethanol-water solution at room temperature were added dropwise simultaneously the following two solutions: (a) sodium azide (8 g, 0.123 mole) in water (ml 50) and (b) trifluoromethylphenylisoyhiocyanate (10 g, 0.049 mole) in ethanol (ml 30). The mixture was stirred overnight, then evaporated to 15 ml. This solution was extracted with 175 ml of 80° C. water and filtered. The solution was cooled to 0° C., acidified to pH 5–7 and filtered. The addition of ice was followed by an addition of hydrochloric acid to pH lower than 3 and collection of the crude product by filtration. Recrystallization from 70% ethanol gave the mercaptotetrazole as white crystals.

Potassium hydroxide (1.96 g, 0.035 mole) in ethanol (ml 37) was then added under stirring at room temperature to the mercatotetrazole (8.6 g, 0.035 mole) in ethanol (10 ml). The resulting solution was evaporated under vacuum to give the 1-(2-trifluoromethylphenyl)-5-mercaptotetrazole potassium salt.

Step 2: Synthesis of Coupler (1)

A solution of α-chloro-α-pyvaloyl-2-chloro-5-(2,4-ditert.-amylphenoxybutyramido)-acetanilide (60.5 g, 0,1 mole) in dimethylformamide (160 ml) was added with the 2-trifluoromethylphenylmercaptotetrazole potassium salt (31.3 g, 0.11 mole) under stirring at room temperature. The mixture was stirred 1 hour, then poured in water. The separated solid was dried under vacuum, crystallized from ethanol (360 ml), then from methanol (600 ml) to give 64 g (yield 78.2%) of Coupler (1).

Elemental Analysis for $C_{41}H_{50}ClF_3N_6O_4S$:
Calculated: C=60.39; H=6.18; N=10.31; S=3.93;
Found: C=60.02; H=6.22; N=10.21; S=4.01
Acidimetric Titration Title : 99.02%

The yellow dye forming DIR couplers of the present invention can be hydrophilic couplers (Fischer type couplers) having a water-solubilizing group, for example a carboxy group, a hydroxy group, a sulfo group, etc., or hydrophobic couplers. As methods for adding the couplers to a hydrophilic colloid solution or to a gelatino-silver halide photographic emulsion or dispersing said couplers thereof, those methods conventionally known in the art can be applied. For example, hydrophobic couplers of the present invention can be dissolved in an high boiling water insoluble solvent and the resulting solution emulsified into an aqueous medium as described for example in U.S. Pat. Nos. 2,304,939, 2,322,027, etc., or said hydrophobic couplers are dissolved in said high boiling water insoluble organic solvent in combination with low boiling organic solvents and the resulting solution emulsified into the aqueous medium as described for example in U.S. Pat. Nos. 2,801,170, 2,801,171, 2,949,360, etc.

The photographic elements of the present invention are preferably multilayer color elements comprising a blue sensitive or sensitized silver halide emulsion layer associated with yellow dye-forming color couplers, a green sensitized silver halide emulsion layer associated with magenta dye-forming color couplers and a red sensitized silver halide emulsion layer associated with cyan dye-forming color couplers. Each layer can be comprised of a single emulsion layer or of multiple emulsion sub-layers sensitive to a given region of the visible spectrum. When multilayer materials contain multiple blue, green or red-sensitive sub-layers, there can be in any case relatively faster and relatively slower sub-layers.

The silver halide emulsion used in this invention may be a fine dispersion of silver chloride, silver bromide, silver chloro-bromide, silver iodobromide and silver chloro-iodo-bromide in a hydrophilic binder. As hydrophilic binder, any hydrophilic polymer of those conventionally used in photography can be employed including gelatin, a gelatin derivative such as acylated gelatin, graft gelatin, etc., albumin, gum arabic, agar agar, a cellulose derivative, such as hydroxyethyl-cellulose, carboxymethylcellulose, etc., a synthetic resin, such as polyvinyl alcohol, polyvinylpyrrolidone, polyacrylamide, etc. Preferred silver halides are silver iodo-bromide or silver iodo-bromo-chloride containing 1 to 20% mole silver iodide. The silver halide grains may have any crystal form such as cubical, octahedral, tabular or a mixed crystal form. The silver halide can have a uniform grain size or a broader grain size distribution. The size of the silver halide ranges from about 0.1 to about 5 μm. The silver halide emulsion can be prepared using a single-jet method, a double-jet method, or a combination of these methods or can be matured using, for instance, an ammonia method, a neutralization method, an acid method, etc. The emulsions which can be used in the present invention can be chemically and optically sensitized as described in Research Disclosure 17643, III and IV, December 1978; they can contain optical brighteners, antifogging agents and stabilizers, filtering and antihalo dyes, hardeners, coating aids, plasticizers and lubricants and other auxiliary substances, as for instance described in Research Disclosure 17643, V, VI, VIII, X, XI and XII, December 1978. The layers of the photographic emulsion and the layers of the photographic element con contain various colloids, alone or in combination, such as binding materials, as for instance described in Research Disclosure 17643, IX, December 1978. The above described emulsions can be coated onto several support bases (cellulose triacetate, paper, resin-coated paper, polyester included) by adopting various methods, as described in Research Disclosure 17643, XV and XVII, December 1978. The light-sensitive silver halides contained in the photographic elements of the present invention after exposure can be processed to form a visible image by associating the silver halide with an aqueous alkaline medium in the presence of a developing agent contained in the water medium or in the element. Formulations and techniques are described in Research Disclosure 17643, XIX, XX and XXI, December 1978.

The present invention will be now illustrated in greater details by making reference to the following example.

EXAMPLE 1

A control multilayer negative color film (Film 1) was made by coating a subbed cellulose triacetate support base with the following layers in the order:

Layer 1. Least sensitive blue-sensitive yellow dye forming silver halide emulsion layer comprising a blend of 65% by weight of a low speed silver bromo-iodide gelatin emulsion (having 96.8% mole bromide, 3.2% mole iodide and an average diameter of 0.53 μm) and 35% by weight of a medium speed silver bromo-iodide gelatin emulsion (having 96.8% mole bromide, 3.2% mole iodide and an average diameter of 0.78 μm). The low and medium emulsions were both chemically sensitized with sulphur and gold compounds, added with stabilizers, antifogging agents and blue spectral sensitizing dyes. The layer was coated at a total silver coverage of 0.5 g/m$^2$, gelatin coverage of 1.1 g/m$^2$, 0.78 g/m$^2$ of the yellow dye forming coupler A, reported below, dispersed in the gelatin with and 0.039 g/m$^2$ of the DIR coupler B, reported below, dispersed in the gelatin.

Layer 2. More sensitive blue sensitive yellow dye forming silver halide emulsion layer comprising a silver bromo-iodide gelatin emulsion (having 92% mole bromide, 8% mole iodide and an average diameter of 1.02

μm) chemically sensitized with sulphur and gold compounds, added with stabilizers and antifogging compounds and blue spectral sensitizing dyes. The layer was coated at silver coverage of 0.55 g/m², gelatin coverage of 0.7 g/m², 0.58 g/m² of coupler A and 0.023 g/m² of coupler B.

Layer 3. Protective gelatin layer comprising matting agents, surfactants and a gelatin hardener coated at gelatine coverage of 1.17 g/m².

A second control multilayer color negative film (Film 2) was made in the same manner of Film 1 except that coupler C was used instead of coupler B in an amount of 0.039 g/m² in layer 1 and 0.024 g/m² in layer 2.

A multilayer color negative film according to the invention (Film 3) was made in the same manner of Film 1 except that coupler (I) was used instead of coupler B in an amount of 0.057 g/m² in layer 1 and 0.034 g/m² in layer 2.

Coupler A:

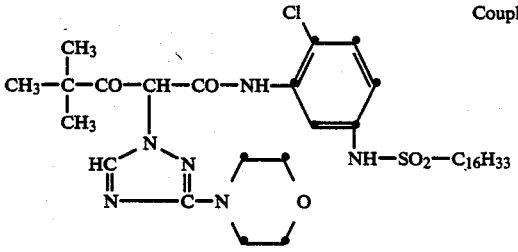

(Coupler B:

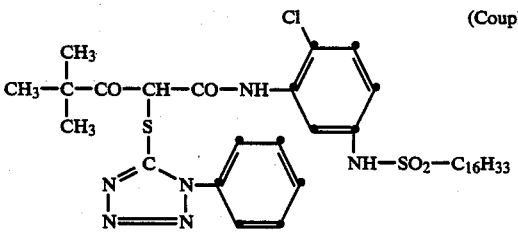

Coupler C:

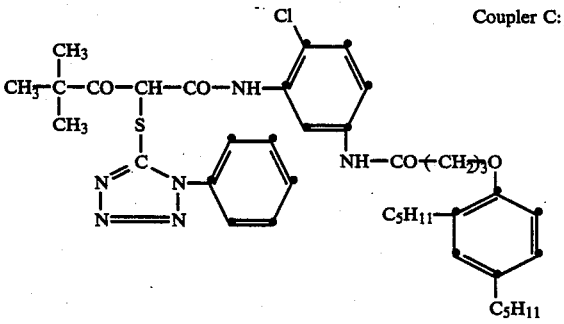

Samples of each film were exposed to a light source having a color temperature of 5,550° K. through an optical step wedge and developed in a standard type C41 process as described in British Journal of Photography, July 12, 1974, pp. 597–598. Table 1 reports the values of fog (Dmin), Dmax, Dmax/Ag coverage, Speed 1 (speed expressed as −logE value at a density=1 above fog, wherein E is Exposure in meter-candle-seconds) and RMS granularity (that is a measure of diffuse granularity as described by H. C. Schmitt and J. H. Altman in "Method of Measuring Diffuse RMS Granularity", Applied Optics, Vol. 9, pages 871–874, April 1970) at various optical densities.

TABLE 1

| Film | Fog | Dmax | Dmax/ Cop.Ag | Sens. 1 | RMS d.o. = 1 | RMS d.o. = 1,8 |
|---|---|---|---|---|---|---|
| 1 | 0.10 | 1.91 | 1.55 | 1.15 | 7.6 | 4.5 |
| 2 | 0.13 | 2.23 | 1.86 | 1.36 | 10.3 | 6.0 |
| 3 | 0.10 | 2.25 | 1.92 | 1.39 | 6.6 | 2.9 |

Film 3 comprising DIR coupler (1) of the present invention shows an improved granularity (the lower the RMS number, the lower the image granularity) and less reduction in maximum color density and sensitivity in comparison with films comprising known DIR couplers.

I claim:

1. A silver halide color photographic light-sensitive material which comprises a support having coated thereon at least one silver halide emulsion layer containing a diketomethylene yellow dye forming coupler having, in the coupling active position thereof, a group which provides a compound having a development inhibiting property when the group is released from the coupler active position upon color development reaction, wherein said group is a 1-(fluoroalkylsubstituted-phenyl)-tetrazolyl-5-thio group.

2. The silver halide color photographic light-sensitive material of claim 1, wherein said yellow dye forming coupler is represented by the general formula (I):

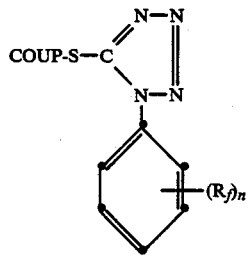

(I)

wherein COUP is a yellow dye forming coupler residue, S is a thio group attached to the coupling active position of COUP, $R_f$ is a fluoroalkyl group and n is an integer of 1 to 5.

3. The silver halide color photographic light-sensitive material of claim 1, wherein said yellow dye forming coupler is represented by the general formula (II):

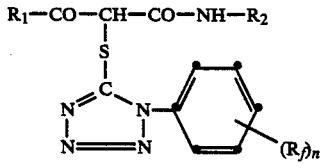

(II)

wherein $R_1$ represents an alkyl group, an aryl group or a $-NR_3R_4$ group, wherein $R_3$ represents a hydrogen atom or an alkyl group and $R_4$ represents an alkyl group or an aryl group, $R_2$ represents an alkyl group or an aryl group, $R_f$ represents a fluoroalkyl group and n represents an integer of 1 to 5.

4. The silver halide color photographic light-sensitive material of claim 1, wherein said yellow dye forming coupler is represented by the general formula (III):

(III)

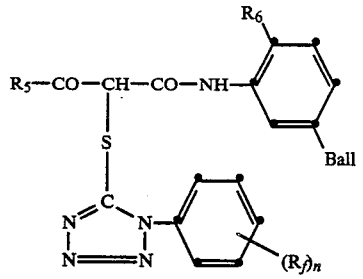

wherein $R_5$ represents an alkyl group or an aryl group, $R_6$ represents a halogen atom, an alkoxy group or an alkyl group, $R_f$ represents a fluoroalkyl group, n is an integer of 1 to 3 and Ball is a hydrophobic ballasting group.

5. The silver halide color photographic light-sensitive material of claim 1, wherein said yellow dye forming coupler is represented by the general formula (IV) or (V):

(IV)

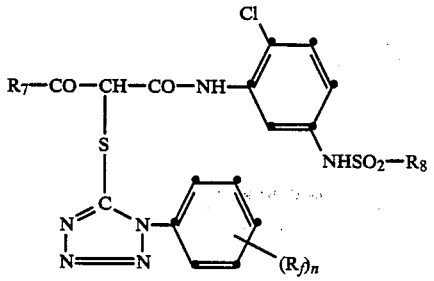

(V)

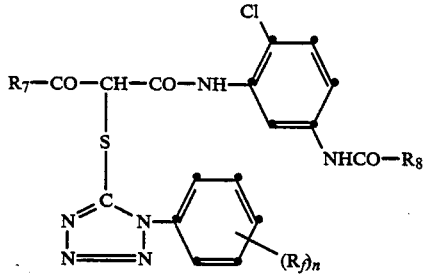

wherein $R_7$ represents a branched chain alkyl group, $R_8$ represents an alkyl group, a phenoxyalkyl group, an alkoxyphenyl group or an aralkyl group, $R_f$ represents a fluoroalkyl group and n is an integer of 1 to 5.

6. The silver halide color photographic light-sensitive material of claim 1, wherein said yellow dye forming coupler is capable of releasing the 1-(fluoroalkylsubstituted-phenyl)-tetrazolyl-5-thio group in a controllable time.

7. The silver halide color photographic light-sensitive material of claim 6, wherein said yellow dye forming coupler is represented by the general formula (VI):

(VI)

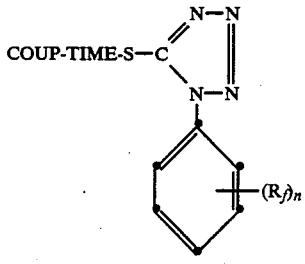

wherein COUP is a yellow dye forming coupler residue, TIME is a timing group joining the coupler group to the 1-(fluoroalkylsubstituted-phenyl)-tetrazolyl-5-thio group and n is an integer of 1 to 5.

8. The material of claim 2 wherein said yellow dye forming coupler is represented by the formula:

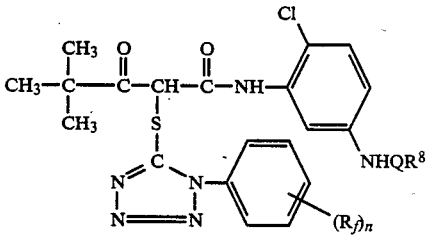

wherein $R_f$ is a fluoroalkyl group, n is an integer of 1 to 5,

Q is —CO— or —$SO_2$—, and $R^8$ is selected from the group consisting of alkyl group, phenoxyalkyl group, alkoxyphenyl group, or an aralkyl group.

9. The material of claim 8 wherein Q is —$SO_2$—.

10. The material of claim 8 wherein Q is —CO—.

11. The material of claim 9 wherein $R_f$ has 1 to 5 carbon atoms.

12. The material of claim 10 wherein $R_f$ has 1 to 5 carbon atoms.

13. The material of claim 11 wherein n is 1.

14. The material of claim 12 wherein n is 1.

* * * * *